US008240827B2

(12) United States Patent
Sasaki

(10) Patent No.: US 8,240,827 B2
(45) Date of Patent: Aug. 14, 2012

(54) LIQUID CONTAINERS

(75) Inventor: Toyonori Sasaki, Anjo (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 344 days.

(21) Appl. No.: 12/720,585

(22) Filed: Mar. 9, 2010

(65) Prior Publication Data

US 2010/0238241 A1 Sep. 23, 2010

(30) Foreign Application Priority Data

Mar. 23, 2009 (JP) ..... 2009-069916

(51) Int. Cl.
*B41J 2/175* (2006.01)

(52) U.S. Cl. ..... 347/86; 347/85

(58) Field of Classification Search ..... 347/49, 347/84, 85, 86

See application file for complete search history.

(56) References Cited

U.S. PATENT DOCUMENTS

| | | | | |
|---|---|---|---|---|
| 6,726,313 | B1 * | 4/2004 | Oda et al. | 347/85 |
| 7,125,108 | B2 * | 10/2006 | Toba et al. | 347/86 |
| 7,278,722 | B2 * | 10/2007 | Sasaki et al. | 347/86 |
| 7,393,088 | B2 * | 7/2008 | Sasaki | 347/84 |
| 2001/0020971 | A1 | 9/2001 | Usui et al. | |
| 2004/0165043 | A1 | 8/2004 | Sakai et al. | |
| 2008/0239036 | A1 | 10/2008 | Hattori | |
| 2009/0141102 | A1 | 6/2009 | Takagi | |

FOREIGN PATENT DOCUMENTS

| | | | |
|---|---|---|---|
| JP | 2001-341324 | A | 12/2001 |
| JP | 2004-249707 | A | 9/2004 |
| JP | 2008-254220 | A | 10/2008 |
| JP | 2009-132115 | A | 6/2009 |

* cited by examiner

*Primary Examiner* — Anh T. N. Vo
(74) *Attorney, Agent, or Firm* — Baker Botts L.L.P.

(57) ABSTRACT

A liquid container includes an air introduction portion including an air introduction chamber, a first path through which the air introduction chamber is configured to communicate with a liquid chamber, a second path extending from the air introduction chamber and is opened to an exterior of an container body, an air communication path through which the air introduction chamber is configured to communicate with the exterior of the container body, a valve member comprising a first valve and a second valve, the valve member being movable, such that when the first valve closes the first path the second valve opens the second path, and when the second valve closes the second path the first valve opens the first path, and an urging member configured to urge the valve member in such a direction that the first valve closes the first path and the second valve opens the second path.

10 Claims, 10 Drawing Sheets

LIQUID CONTAINERS

CROSS REFERENCE TO RELATED APPLICATION

The present application claims priority to and the benefit of Japanese Patent Application No. 2009-069916, which was filed on Mar. 23, 2009, the disclosure of which is incorporated herein by reference in its entirety.

BACKGROUND OF THE INVENTION

The present invention relates to liquid containers configured to be mounted to a container mounting portion of a liquid supply device.

DESCRIPTION OF RELATE ART

As an example of a known liquid container and a known container mounting portion of a liquid supply device to which the liquid container is to be mounted, an ink cartridge and an ink cartridge mounting portioning portion of an inkjet recording apparatus are known. For example, a known ink cartridge, such as described in Japanese Unexamined Patent Application Publication No. 2008-254220, has an air communication opening allowing an ink chamber formed in the ink cartridge and the atmosphere to communicate with each other, and an air communication valve configured to close the air communication opening. When the ink cartridge is mounted to an ink cartridge mounting portion in a mounting direction, the air communication valve comes into contact with the cartridge mounting portion and moves in a direction opposite to the mounting direction. When the air communication valve moves in the direction opposite to the mounting direction, the air communication opening is opened, and the ink chamber and the atmosphere communicate with each other through the air communication opening. Thus, the air communication valve closes the air communication opening until the ink cartridge is mounted to the ink cartridge mounting portion. Accordingly, ink can be prevented from leaking from the air communication opening to the exterior of the ink cartridge until the ink cartridge is mounted to the ink cartridge mounting portion. During the mounting of the ink cartridge to the cartridge mounting portion, the air communication valve is moved, such that the ink chamber and the atmosphere can be made to communicate with each other. Moreover, after the ink cartridge has been mounted to the ink cartridge mounting portion, the atmosphere can be introduced into the ink chamber as the ink is supplied from the ink cartridge to an inkjet recording apparatus.

However, in the above ink cartridge, for example, because the ink chamber and the atmosphere communicate with each other once the air communication opening is opened by mounting the ink cartridge to the ink cartridge mounting portion, ink may leak from a portion near the contact point (interface) between the air communication valve and the cartridge mounting portion to the exterior of the ink cartridge if the inkjet recording apparatus is shaken or moved with the ink cartridge being mounted on the ink cartridge mounting portion. Such a situation may occur as follows. For example, an inkjet recording apparatus causes some malfunction, and the user sends the inkjet recording apparatus back to the manufacturer for repair, with the ink cartridge being mounted thereon. During the transportation, the inkjet recording apparatus may be shaken or turned upside down. Consequently, ink may leak from the air communication opening or from a portion near the contact point (interface) between the air communication valve and the cartridge mounting portion to the exterior of the ink cartridge.

In this respect, another known ink cartridge, such as described in Japanese Unexamined Patent Application Publication No. 2004-249707, has an atmosphere valve configured to open and close a communication port, which is a portion of an air communication path extending from an ink chamber to an opening, and a film covering the communication port and the atmosphere valve so as not to expose the communication port and the atmosphere valve to the exterior of the ink cartridge. When the ink cartridge is mounted to a carriage of an inkjet recording apparatus, a projection provided on the carriage pushes up a shaft of the atmosphere valve with the film interposed therebetween. In this manner, the communication port is opened, and the ink chamber communicates with the atmosphere through the air communication path. Because the communication port and the atmosphere valve are covered with the film, ink is prevented from leaking to the exterior of the ink cartridge from a portion near the contact point (interface) between the atmosphere valve and the projection of the carriage with the film being interposed therebetween.

In the case where a film is used as in the ink cartridge described in Japanese Unexamined Patent Application Publication No. 2004-249707, if the mounting of the ink cartridge to the ink cartridge mounting portion is repeated, the film may rub against the shaft of the atmosphere valve, which is movable, and against the projection of the carriage. Consequently, the film may be broken. In that event, ink may leak to the exterior of the ink cartridge through the broken film. Moreover, even if the mounting of the ink cartridge to the ink cartridge mounting portioning portion is not repeated, the film may rub against an object other than the ink cartridge while being handled by the user because the film is provided on the outer surface of the ink cartridge. This also produces a possibility of breakage of the film. Furthermore, because the atmosphere valve is not movable by more than an amount that the film can warp, the movable range of the atmosphere valve is limited. Therefore, if the ink cartridge is mounted to the carriage with a slight tilt, the atmosphere valve may not reach a position at which the communication port is opened, and the atmosphere and the ink chamber may not assuredly communicate with each other.

SUMMARY OF THE INVENTION

Therefore, a need has arisen for liquid containers which overcome these and other shortcomings of the related art. A technical advantage of the present invention is that a valve member is assuredly moved by coming into contact with a container mounting portion when a liquid container is mounted to the container mounting portion, such that a liquid chamber and the atmosphere assuredly communicate with each other through an air communication path, and leakage of liquid from a portion near a contact point (interface) between the valve member and the container mounting portion to an exterior of the liquid container is reduced.

According to an embodiment of the present invention, a liquid container is configured to be mounted to a container mounting portion of a liquid supply device in a mounting direction. The liquid container comprises a container body comprising a liquid chamber formed therein. The liquid chamber is configured to store liquid therein, and the container body comprises a front face facing forward in the mounting direction during a mounting of the liquid container to the container mounting portion. The liquid container also comprises a liquid supply portion configured to supply liquid from the liquid chamber to an exterior of the container body, and an air introduction portion configured to introduce air from the exterior of the container body into the liquid chamber. The air introduction portion comprises an air introduction chamber, a first path through which the air introduction chamber is configured to be in communication with the liquid chamber, a second path extending in the mounting direction from the air introduction chamber and is opened to the exterior of the container body at the front face of the container body, an air communication path through which the air introduction chamber is configured to be in communication with the exterior of the container body, wherein the air communication path is configured to introduce air into the air introduction chamber therethrough, a valve member extending through the first path and the second path and comprising a first valve configured to open and close the first path and a second valve configured to open and close the second path, the valve member being movable, such that when the first valve closes the first path the second valve opens the second path, and when the second valve closes the second path the first valve opens the first path, and an urging member configured to urge the valve member in such a direction that the first valve closes the first path and the second valve opens the second path. The valve member is configured to be moved relative to the air introduction chamber in a direction opposite to the mounting direction against an urging force of the urging member by coming into contact with the container mounting portion when the liquid container is mounted to the container mounting portion, such that the second valve closes the second path and the first valve opens the first path.

According to another embodiment of the present invention, a liquid container comprises a container body comprising a liquid chamber formed therein, and the liquid chamber is configured to store liquid therein. The liquid container also comprises a liquid supply portion configured to supply liquid from the liquid chamber to an exterior of the container body, and an air introduction portion configured to introduce air from the exterior of the container body into the liquid chamber. The air introduction portion comprises an air introduction chamber, a first path through which the air introduction chamber is configured to be in communication with the liquid chamber, a second path extending from the air introduction chamber and is opened to the exterior of the container body, an air communication path through which the air introduction chamber is configured to be in communication with the exterior of the container body, wherein the air communication path is configured to introduce air into the air introduction chamber, a valve member extending through the first path and the second path and comprising a first valve configured to open and close the first path and a second valve configured to open and close the second path, the valve member being movable, such that when the first valve closes the first path the second valve opens the second path, and when the second valve closes the second path the first valve opens the first path, and an urging member configured to urge the valve member in such a direction that the first valve closes the first path and the second valve opens the second path. The valve member is configured such that, when the valve member is moved by an external force acting against an urging force of the urging member, the second valve closes the second path and the first valve opens the first path.

Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, needs satisfied thereby, and the objects, features, and advantages thereof, reference now is made to the following description taken in connection with the accompanying drawing.

DETAILED DESCRIPTION OF EMBODIMENTS OF THE INVENTION

Figure 1:
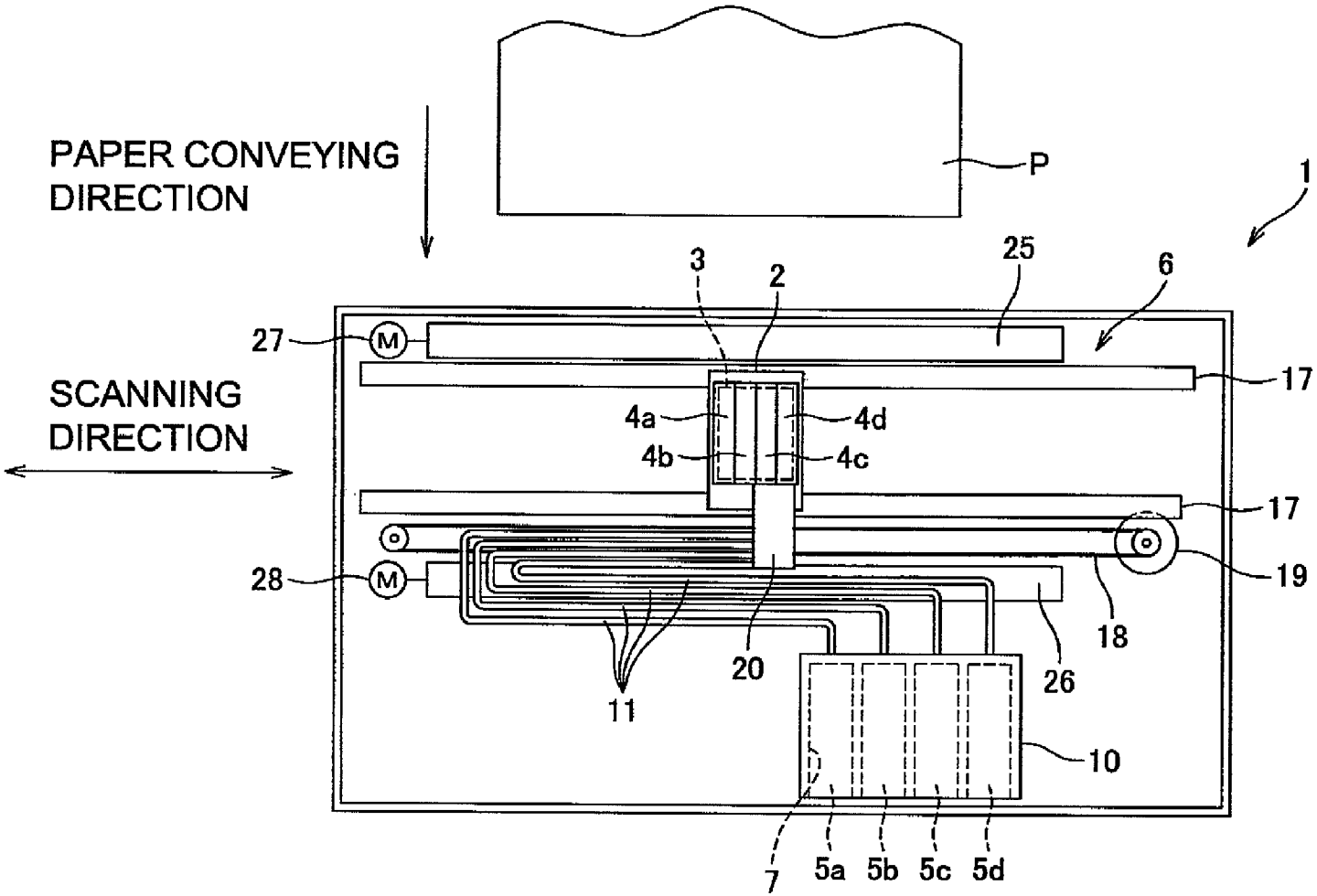
FIG. 1 is a plan view of a printer to which an ink cartridge according to an embodiment is to be mounted.

Embodiments of the present invention, and their features and advantages, may be understood by referring to FIGS. 1-10, like numerals being used for like corresponding parts in the various drawings.

In this embodiment, the present invention is applied to an ink cartridge 5 (liquid container) configured to be removably mounted to a cartridge mounting portion 7 (container mounting portion) of a holder 10 (liquid supply device) of an inkjet printer 1 (hereinafter, printer 1) configured to record an image on a recording medium, e.g., a sheet of paper, by ejecting ink toward the recording medium. Herein, mounting the ink cartridge 5 to the cartridge mounting portion 7 is also simply referred to as mounting the ink cartridge 5 to the printer 1.

Referring to FIG. 1, the printer 1 comprises a carriage 2 configured to reciprocate in a scanning direction shown in FIG. 1, an inkjet head 3 and sub-tanks 4*a* to 4*d* mounted on the carriage 2, the holder 10 to which four ink cartridges 5*a* to 5*d* are to be mounted, a conveyance mechanism 6 that conveys a sheet of paper P in a paper conveying direction shown in FIG. 1.

The carriage 2 is configured to reciprocate along two guide shafts 17 extending parallel to each other in the lateral direction (scanning direction) in FIG. 1. An endless belt 18 is connected to the carriage 2. When the endless belt 18 is driven to run by a carriage drive motor 19, the carriage 2 moves in the scanning direction with the running of the endless belt 18.

The inkjet head 3 has in the bottom face thereof (the face hidden behind in FIG. 1) a number of ink ejection nozzles. The four sub-tanks 4*a* to 4*d* are arranged side by side in the scanning direction. A tube joint 20 is integrally provided on the four sub-tanks 4*a* to 4*d*. The four sub-tanks 4*a* to 4*d* are in fluid communication with the holder 10 through flexible tubes 11 connected to the tube joint 20.

The holder 10 comprises four cartridge mounting portions 7 (container mounting portions) arranged in one direction (the scanning direction in FIG. 1). The four ink cartridges 5*a* to 5*d* are mounted to the four cartridge mounting portions 7, respectively. The four ink cartridges 5*a* to 5*d* store inks of four colors: black, yellow, cyan, and magenta, respectively. Details of the cartridge mounting portions 7 will be described separately below.

The inks of the four colors respectively stored in the four ink cartridges 5*a* to 5*d* are supplied to the four sub-tanks 4*a* to 4*d* through the four tubes 11 connected to the holder 10, are temporarily stored in the sub-tanks 4*a* to 4*d*, and are subsequently supplied to the inkjet head 3. While the inkjet head 3 reciprocates in the scanning direction together with the carriage 2, the inkjet head 3 ejects ink droplets from a number of the ink ejection nozzles provided in the bottom face thereof onto the sheet of paper P conveyed in the downward direction (paper conveying direction) in FIG. 1 by the conveyance mechanism 6.

The conveyance mechanism 6 comprises a paper feed roller 25 provided on the upstream side in the paper conveying direction with respect to the inkjet head 3, and a paper discharge roller 26 provided on the downstream side in the paper feed direction with respect to the inkjet head 3. The paper feed roller 25 and the paper discharge roller 26 are driven to rotate by a paper feed motor 27 and a paper discharge motor 28, respectively. The conveyance mechanism 6 is configured to feed the sheet of paper P to the inkjet head 3 from the upper side in FIG. 1 by using the paper feed roller 25, and to discharge the sheet of paper P having an image, characters, or the like recorded thereon by the inkjet head 3 toward the lower side in FIG. 1 by using the paper discharge roller 26.

Figure 2B:
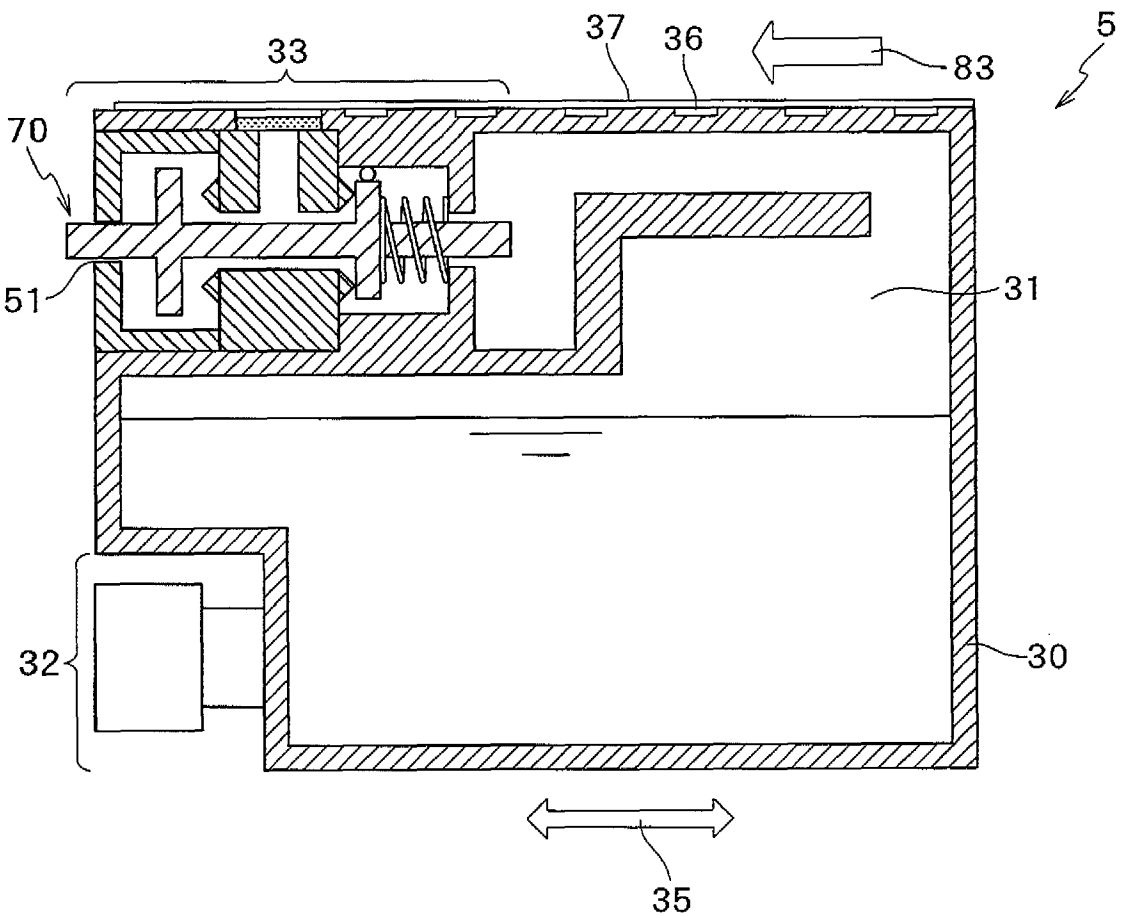
FIG. 2B is a cross-sectional view of the ink cartridge.

Next, referring to FIG. 2A to FIG. 5, the ink cartridges 5*a* to 5*d* will be described. Since the four ink cartridges 5*a* to 5*d* respectively storing inks of the four colors have identical configurations, the following description will be provided focusing on one of them (hereinafter, ink cartridge 5). In FIG. 2B, an ink supply portion 32 is shown in side view, not in cross-sectional view. A direction in which the ink cartridge 5 is moved during mounting of the ink cartridge 5 to the cartridge mounting portion 7 is defined as a mounting direction 83, and a direction opposite thereto is defined as a direction opposite to the mounting direction 83 (removal direction).

Figure 2A:
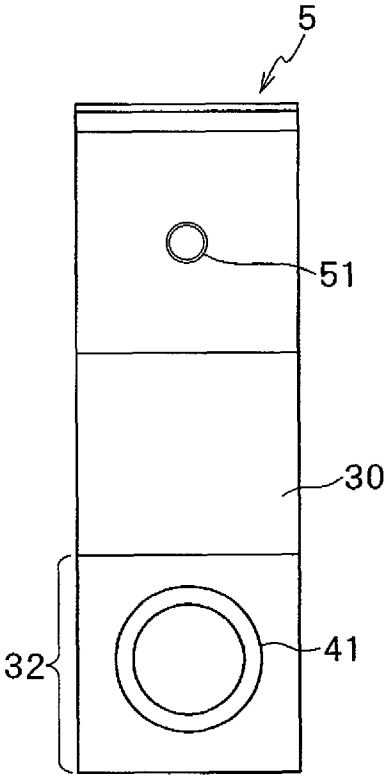
FIG. 2A is a front view of an ink cartridge according to an embodiment.

Referring to FIGS. 2A and B, the ink cartridge 5 (liquid container) comprises a casing 30 (container body), an ink chamber 31 (liquid chamber) formed in the casing 30 and configured to store ink therein, the ink supply portion 32 (liquid supply portion) configured to supply ink stored in the ink chamber 31 to an ink supply system (the holder 10 and the four tubes 11) of the printer 1, and the air introduction portion 33 configured to introduce air from the exterior of the casing 30 into the ink chamber 31. The casing 30 is made of, for example, a resin material such as polyacetal, nylon, polyethylene, or polypropylene. Among the outer faces of the casing 30, the face facing forward in the mounting direction 83 during the mounting of the ink cartridge 5 to the cartridge mounting portion 7 (the face on the left side in FIG. 2B) is referred to as the front face, and the face facing rearward during the mounting of the ink cartridge 5 to the cartridge mounting portion 7 (the face on the right side in FIG. 2B) is referred to as the rear face. Furthermore, among the outer surfaces of the casing 30, in the state where the ink cartridge 5 is mounted on the cartridge mounting portion 7, the face at the top end (the face on the upper side in FIG. 2B) is referred as the top face, and the face at the bottom end (the face on the lower side in FIG. 2B) is referred to as the bottom face.

Referring to FIGS. 2A and B, the ink supply portion 32 is positioned at a lower portion of the front face of the casing 30, i.e., positioned at the front face of the casing 30 adjacent to the bottom face of the casing 30. The ink supply portion 32 has a circular opening 41 formed therein. Moreover, a path allowing (not shown) the opening 41 and the ink chamber 31 to communicate with each other is formed in the ink supply portion 32, and an ink supply valve is positioned in the ink supply portion 32. The ink supply valve is configured to open and close the path allowing the opening 41 and the ink chamber 31 to communicate with each other.

When the ink cartridge 5 is mounted to the cartridge mounting portion 7 (see FIGS. 6 and 7), an ink supply tube 80 described below (see FIGS. 6 and 7) is inserted into the ink supply portion 32. When the ink supply tube 80 is inserted through the opening 41 into the ink supply portion 32, the ink supply valve opens the path allowing the opening 41 and the ink chamber 31 to communicate with each other. Thus, when the ink cartridge 5 is mounted to the cartridge mounting portion 7, ink stored in the ink chamber 31 can be supplied to the sub-tanks 4*a* to 4*d* through the ink supply tube 80, the tube 11, and the tube joint 20.

Figure 4:
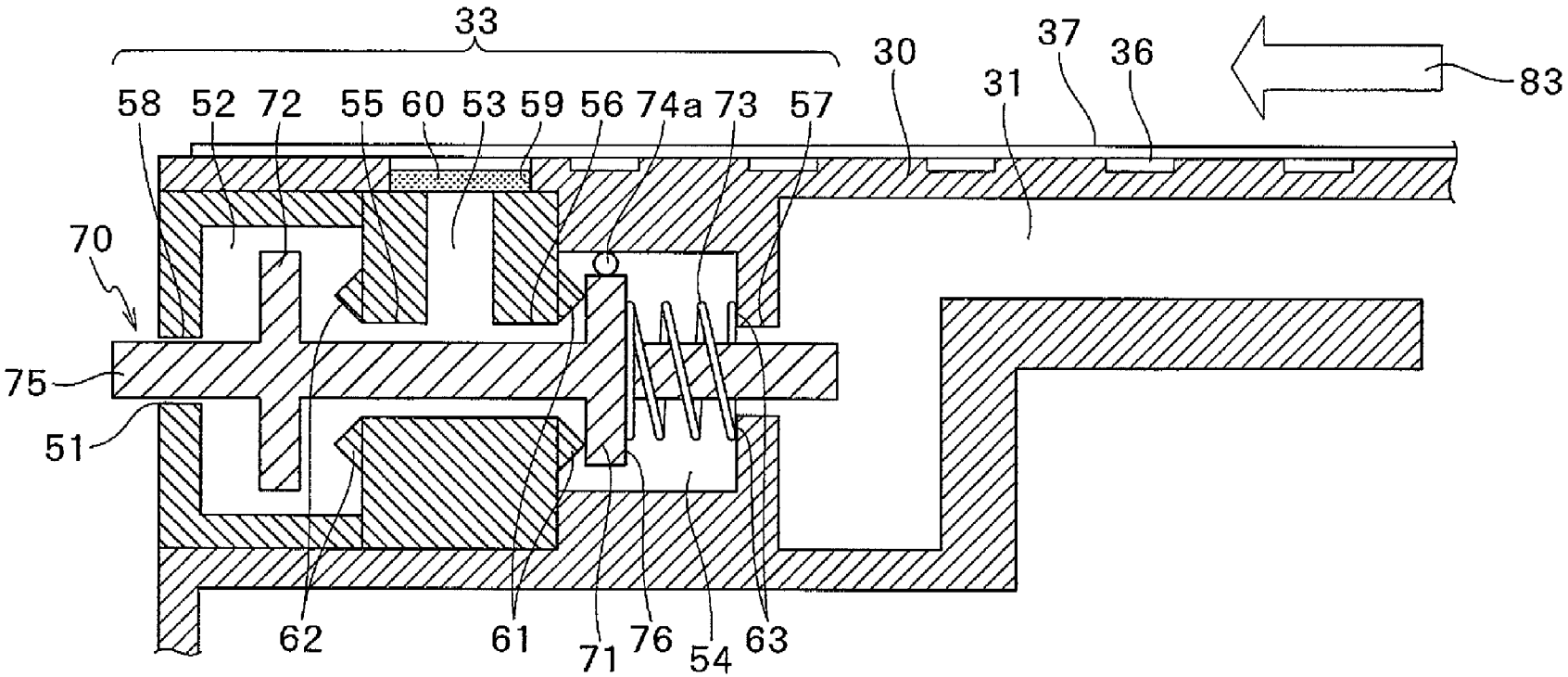
FIG. 4 is an enlarged cross-sectional view of an air introduction portion of the ink cartridge of FIGS. 2A and 2B.

Referring to FIGS. 2A, 2B and FIG. 4, the casing 30 comprises the air introduction portion 33 in an upper portion thereof. Referring to FIG. 4, the air introduction portion 33 comprises an air introduction chamber 53, a first communication path 56 (a portion of a first path), a second communication path 55 (a portion of a second path), a third communication path 59 (a portion of an air communication path), a first movement-allowing chamber 54 (a portion of the first path), a second movement-allowing chamber 52 (a portion of the second path), a labyrinth groove 36 (a portion of the air communication path), a valve member 70 comprising a first valve 71 and a second valve 72, and a spring 73 (an urging member) configured to urge the valve member 70. The first communication path 56, the second communication path 55, the third communication path 59, the first movement-allowing chamber 54, and the second movement-allowing chamber 52 all have cylindrical shapes. The diameters of the first communication path 56, the second communication path 55, and the third communication path 59 are less than the diameters of the first movement-allowing chamber 54 and the second movement-allowing chamber 52. Details of the air introduction portion 33 will now be described.

The casing 30 has a circular opening 51 (a portion of the second path) formed in an upper portion of the front face of the casing 30, i.e., formed in the front face of the casing 30 adjacent to the top face of the casing 30. The diameter of the opening 51 is less than the diameter of the second movement-allowing chamber 52. Referring to FIG. 4, the second movement-allowing chamber 52 serving as a space allowing the second valve 72 of the valve member 70 to move, the air introduction chamber 53, and the first movement-allowing chamber 54 serving as a space allowing the first valve 71 of the valve member 70 to move are formed in the casing 30. The second movement-allowing chamber 52, the air introduction chamber 53, and the first movement-allowing chamber 54 are aligned in this order from the opening 51 toward the rear face of the casing 30.

Moreover, a cylindrical communication path 58 (a portion of the second path) through which the opening 51 and the second movement-allowing chamber 52 are configured to be in fluid communication with each other, the second communication path 55 through which the second movement-allowing chamber 52 and the air introduction chamber 53 are configured to be in fluid communication with each other, the first communication path 56 through which the air introduction chamber 53 and the first movement-allowing chamber 54 are configured to be in fluid communication with each other, and a cylindrical communication path 57 (a portion of the first path) through which the first movement-allowing chamber 54 and the ink chamber 31 are configured to be in fluid communication with each other are formed in the casing 30. The communication path 57, the first communication path 56, the second communication path 55, and the communication path 58 are arranged in a straight line from the ink chamber 31 to the opening 51. The communication path 57, the first movement-allowing chamber 54, the first communication path 56, the air introduction chamber 53, the second communication path 55, the second movement-allowing chamber 52, the communication path 58, and the opening 51 are arranged in this order in the mounting direction 83, i.e., in a depth direction 35 of the casing 30. The depth direction 35 of the casing 30 is a direction in which a line connecting the front face and the rear face of the casing 30 extends. The diameter of the communication path 58 is equal to the diameter of the opening 51. The diameter of the communication path 57 is less than the diameter of the first movement-allowing chamber 54.

An annular valve seat 61 is positioned at the outer rim of an end of communication path 56 contiguous to the first movement-allowing chamber 54, and the valve seat 61 is configured to come into contact with the first valve 71 of the valve member 70. Likewise, an annular valve seat 62 is positioned at the outer rim of an end of the second communication path 55 contiguous to the second movement-allowing chamber 52, and the valve seat 62 is configured to come into contact with the second valve 72 of the valve member 70. That is, the annular valve seats 61 and 62 are provided surrounding the ends of the first communication path 56 and the second communication path 55, respectively. Elastic members, such as flexible resin or rubber, having elasticity are used as the valve seats 61 and 62.

The third communication path 59 configured to introduce air into the air introduction chamber 53 is provided above the air introduction chamber 53. The air introduction chamber 53 is configured to be in gas communication with the exterior of the casing 30 thorough the third communication path 59. A gas permeable film 60 is positioned in the third communication path 59, such that the gar permeable film 60 closes the third communication path 59.

The gas permeable film 60 is made of a porous film composed of polytetrafluoroethylene (PTFE), polypropylene (PP), or the like. At atmospheric pressure, the film allows gas to pass therethrough but does not allow ink to pass therethrough. The average pore diameter of the porous film used herein falls within the range from 0.2 to 5 micrometers (μm).

The material and structure of the gas permeable film 60 are not specifically limited, as long as the gas permeable film 60 is a film that allows gas to pass therethrough but does not allow ink to pass therethrough. The gas permeable film 60 may be a porous film composed of fluorocarbon resin such as polychlorotrifluoroethylene (PCTFE), tetrafluoroethylene-hexafluoropropylene copolymer, tetrafluoroethylene-perfluoroalkylvinylether copolymer, or tetrafluoroethylene-ethylene copolymer, other than polytetrafluoroethylene (PTFE) or polypropylene (PP). The average pore diameter of the porous film used herein falls within the range from 0.2 to 5 μm. If the average pore diameter is less than 0.2 μm, the gas permeability is reduced, showing a tendency that it is difficult to quickly equalize the pressure inside the ink chamber 31 with the atmospheric pressure. If the average pore diameter is greater than 5 μm, the strength of the film is reduced, showing a tendency that the film is easily broken.

Referring to FIG. 4, the valve member 70 integrally comprises a shaft 75 extending in the mounting direction 83 (the depth direction 35), and the first valve 71 and the second valve 72 provided on the shaft 75. The first valve 71 and the second valve 72 are configured to open and close the first communication path 56 and the second communication path 55, respectively. The valve member 70 movably extends through the communication path 57, the first communication path 56, the second communication path 55, and the communication path 58 arranged in a straight line from the ink chamber 31 to the opening 51. The first valve 71 and the second valve 72 each have a disc-like shape. The first valve 71 is positioned in the first movement-allowing chamber 54. The second valve 72 is positioned in the second movement-allowing chamber 52. The first valve 71 and the second valve 72 are positioned, such that when the first valve 71 is in a position in which the first valve 71 contacts the valve seat 61 and closes the first communication path 56, the second valve 72 is in a position in which the second valve 72 is separated from valve seat 62 and opens the second communication path 55. Moreover, the first valve 71 and the second valve 72 are positioned, such that when the second valve 72 is in a position in which the second valve 72 contacts the valve seat 62 and closes the second communication path 55, the first valve 71 is in a position in which the first valve 71 is separated from valve seat 61 and opens the first communication path 56. The spring 73 is a metal coil spring. The shaft 75 extends through the spring 73 such that one end of the spring 73 is in contact with a wall 63 defining an end of the first movement-allowing chamber 54 on the side of the communication path 57 whereas the other end of the spring 73 is in contact with a side face 76 of the first valve 71 on the side of the communication path 57. The spring 73 is contracted between the wall 63 and the side face 76 so as to be shorter than its natural length. That is, the spring 73 urges the valve member 70 in such a direction (the mounting direction 83) that the first valve 71 closes the first communication path 56 and the second valve 72 opens the second communication path 55. When the valve member 70 is moved against the urging force of the spring 73, the second valve 72 closes the second communication path 55, and the first valve 71 opens the first communication path 56. An end of the shaft 75 projects to the exterior of the casing 30 through the opening 51. When the first valve 71 comes into contact with the valve seat 61, the valve seat 61 deforms elastically and is closely pressed against the first valve 71. Likewise, when the second valve 72 comes into contact with the valve seat 62, the valve seat 62 deforms elastically and is closely pressed against the second valve 72.

Figure 5:
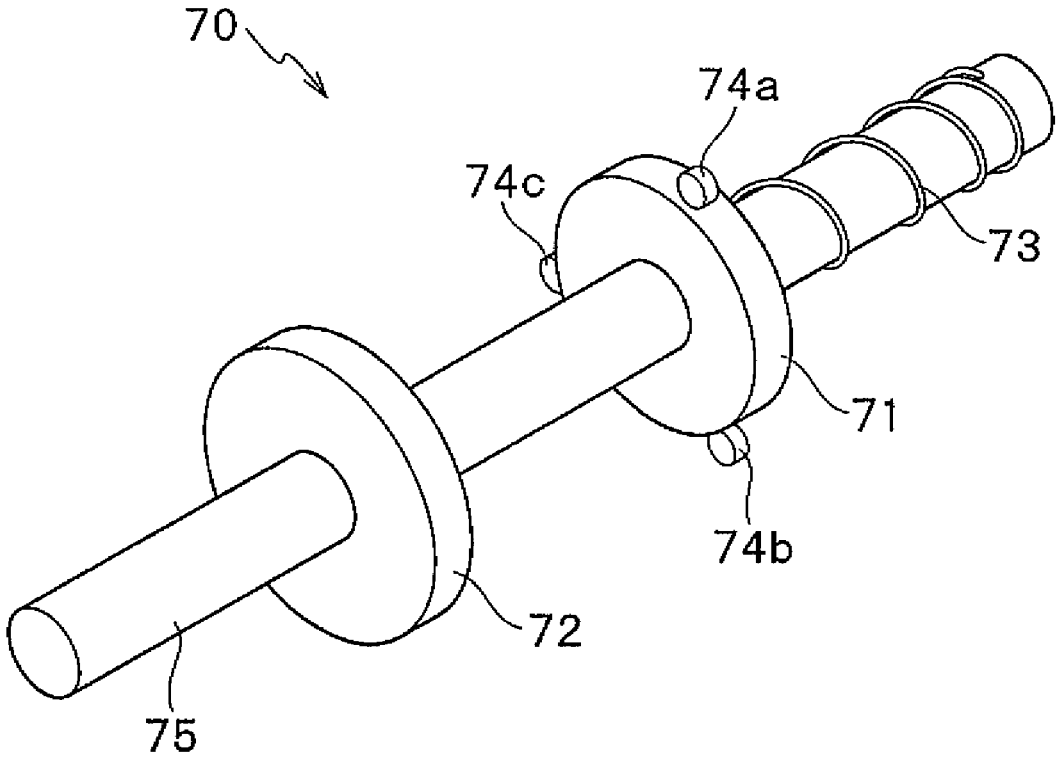
FIG. 5 is a perspective view of a valve member of the ink cartridge of FIGS. 2A and 2B.

Referring to FIG. 5, the first valve 71 comprises on the outer periphery thereof three projecting members 74*a*, 74*b*, and 74*c* provided at intervals in the peripheral direction of the first valve 71. The projecting members 74*a*, 74*b*, and 74*c* are in contact with the inner wall defining the first movement-allowing chamber 54. Thus, the contact area between the inner wall of the first movement-allowing chamber 54 and the first valve 71 can be reduced, and the sliding resistance occurring when the valve member 70 is moved can be reduced. In another embodiment, the second valve 72 may comprise projecting members.

Figure 3:
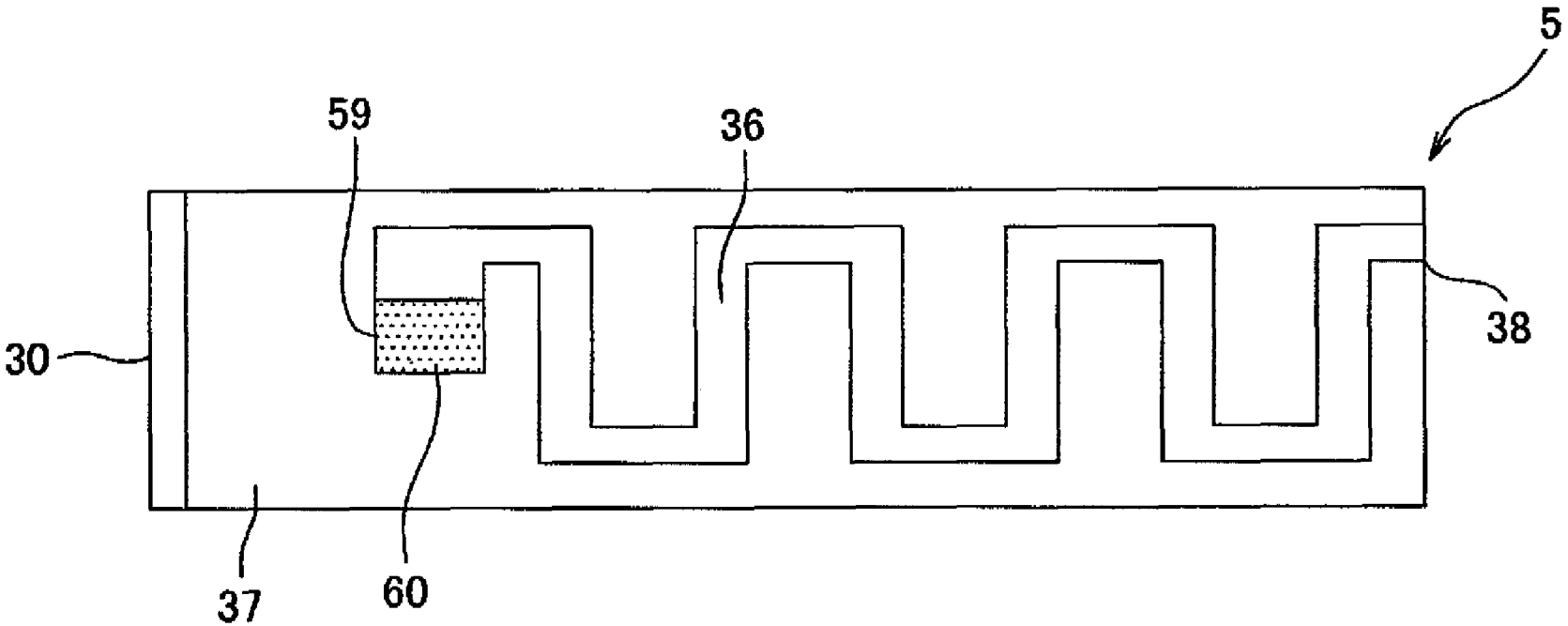
FIG. 3 is a top view of the ink cartridge of FIGS. 2A and 2B.

Referring to FIG. 3, the casing 30 has the labyrinth groove 36 formed in the top face of the casing 30. The labyrinth groove 36 is a narrow groove having a winding shape and extending from the third communication path 59 to an end opening 38 so that the third communication path 59 and the exterior of the casing 30 communicate with each other. The end opening 38 is formed in the rear face of the casing 30. The end opening 38 is positioned above the second communication path 55, the movement-allowing chamber 52, the communication path 58, and the circular opening 51. Therefore, the labyrinth groove 36 is opened to the exterior of the casing 30 at a position above the second communication path 55, the movement-allowing chamber 52, the communication path 58, and the circular opening 51. Moreover, a film 37 that does not allow gas and liquid to pass therethrough is bonded to the top face of the casing 30 so as to cover the entirety of the third communication path 59 and the labyrinth groove 36. Thus, air can be introduced into the ink chamber 31, while drying of ink in the ink chamber 31 can be reduced. Because the labyrinth groove 36 has a narrow winding shape, the ink hardly reaches the exterior of the casing 30 through the labyrinth groove 36.

Next, the cartridge mounting portion 7 (container mounting portion) to which the ink cartridge 5 is to be mounted will be described. Because the cartridge mounting portions 7 to which the four ink cartridges 5*a* to 5*d* are to be mounted have identical configurations, the following description will be provided focusing on one of them.

Figure 6:
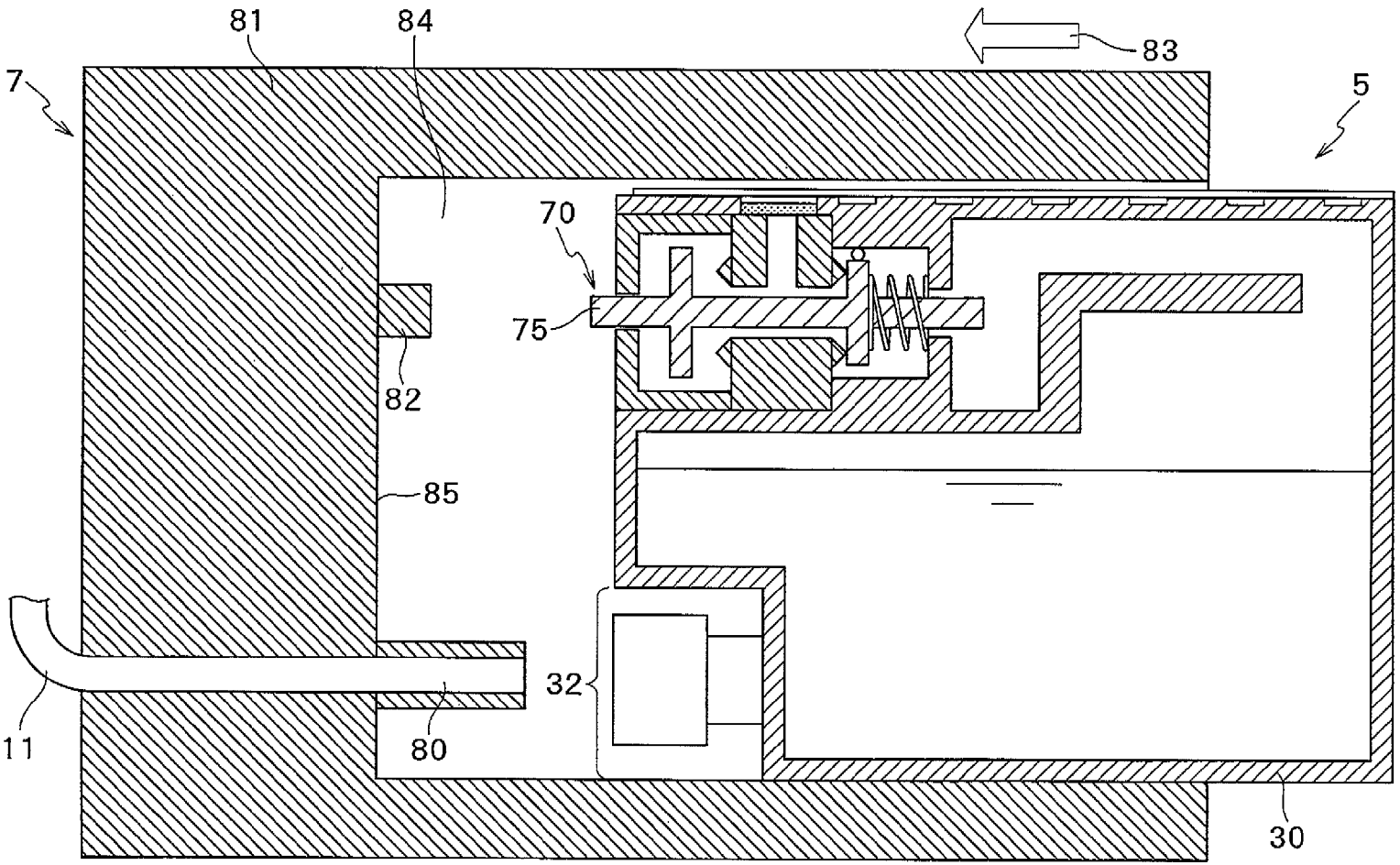
FIG. 6 is a cross-sectional view of the ink cartridge of FIGS. 2A and 2B and a cartridge mounting portion according to an embodiment, during mounting of the ink cartridge to the cartridge mounting portion.

Referring to FIG. 6, the cartridge mounting portion 7 comprises a frame 81 having a box-like U shape with an open end in a cross-sectional view. An inner space 84 is formed in the frame 81 and serves as a space for receiving the ink cartridge 5.

Referring to FIG. 6, the frame 81 comprises a wall surface 85 positioned opposite the open end of the frame 81 and facing the inner space 84, and a pressing portion 82 projecting from the wall surface 85 into the inner space 84. The pressing portion 82 is provided at such a position that, when the ink cartridge 5 is on the cartridge mounting portion 7, the pressing portion 82 faces the shaft 75 of the valve member 70 of the ink cartridge 5. Thus, when the ink cartridge 5 is inserted into the cartridge mounting portion 7, the pressing portion 82 comes into contact with the shaft 75 of the valve member 70 and presses the valve member 70 in the direction opposite to the mounting direction 83.

Referring to FIG. 6, the ink supply tube 80 is provided at a lower portion of the wall surface 85, and the ink supply tube 80 is configured to be connected to the ink supply portion 32. The ink supply tube 80 is provided at such a position as to face the ink supply portion 32 of the ink cartridge 5. The ink supply tube 80 is a resin tube. The ink supply tube 80 is connected to the flexible tube 11 on the back side of the frame 81, as shown in FIG. 6.

Figure 7:
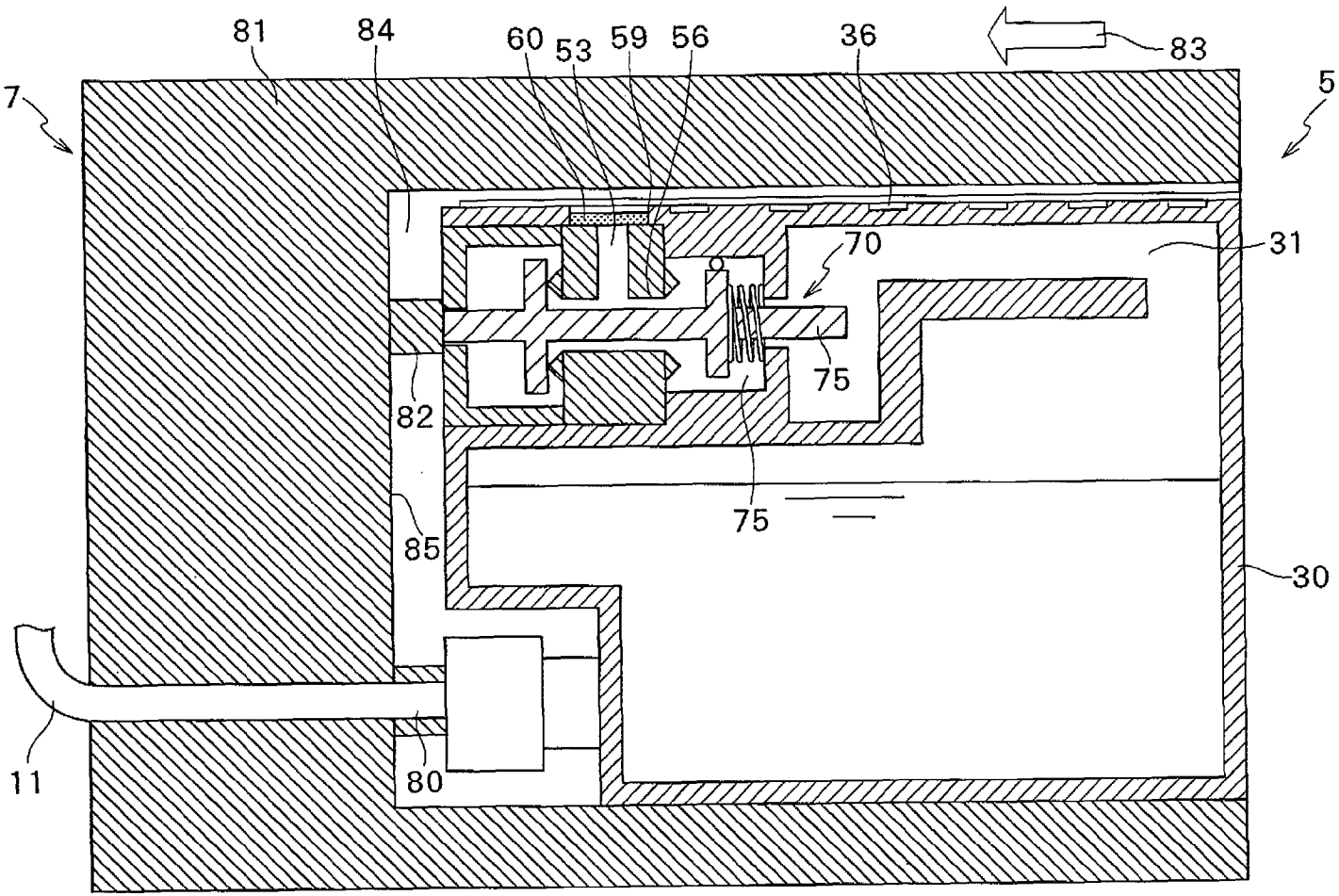
FIG. 7 is a cross-sectional view of the ink cartridge of FIGS. 2A and 2B and the cartridge mounting portion of FIG. 6, in which the mounting of the ink cartridge to the cartridge mounting portion is completed.

Referring to FIGS. 6 and 7, mounting of the ink cartridge 5 to the cartridge mounting portion 7 will now be described. In FIGS. 6 and 7, the ink supply portion 32 is shown in side view, not in cross-sectional view. In this embodiment, the mounting direction 83 is a horizontal direction.

Referring to FIG. 6, before the ink cartridge 5 is mounted to the cartridge mounting portion 7, the valve member 70 is urged by the spring 73 such that, in the air introduction portion 33 of the ink cartridge 5, the first valve 71 is in contact with the valve seat 61 and closes the first communication path 56 whereas the second valve 72 is separated from the valve seat 62 and opens the second communication path 55. In this state, because the first communication path 56 is closed, ink does not flow into the air introduction chamber 53 and does not leak to the exterior of the ink cartridge 5.

Referring to FIGS. 6 and 7, when the ink cartridge 5 is inserted into the inner space 84 of the cartridge mounting portion 7, the front face of the casing 30 of the ink cartridge 5 faces the wall surface 85 of the frame 81. When the ink cartridge 5 is inserted into the cartridge mounting portion 7 in the mounting direction 83, the pressing portion 82 of the ink cartridge 5 first comes into contact with the shaft 75 of the valve member 70.

When the ink cartridge 5 is inserted further into the inner space 84 and the ink cartridge 5 is pushed in the mounting direction 83 with the pressing portion 82 and the shaft 75 being in contact with each other, the casing 30 is moved in the mounting direction 83 relative to the cartridge mounting portion 7, while the shaft 75 of the valve member 70 contacts the pressing portion 82 and does not move relative to the cartridge mounting portion 7. That is, the casing 30 is moved toward the wall surface 85.

In this process, the valve member 70 moves relative to the casing 30 in the direction opposite to the mounting direction 83. That is, the valve member 70 moves in the direction opposite to the mounting direction 83 relative to the air introduction chamber 53. Consequently, the valve member 70 is moved to such a position that the first valve 71 is spaced apart from the valve seat 61 and opens the first communication path 56 whereas the second valve 72 is in contact with the valve seat 62 and closes the second communication path 55. Thus, referring to FIG. 7, the ink chamber 31 and the exterior of the casing 30 are in gas communication with each other through the communication path 57, the first movement-allowing chamber 54, the first communication path 56, the air introduction chamber 53, the third communication path 59, the gas permeable film 60, the labyrinth groove 36, and the end opening 38. Thus, the air can be introduced into the ink chamber 31 through the gas permeable film 60. Moreover, because the second valve 72 comes into contact with the valve seat 62 and closes the second communication path 55, even if the ink stored in the ink chamber 31 happens to flow into the air introduction chamber 53 through the first communication path 56 that has been opened, the ink can be prevented from leaking to the exterior of the casing 30 from the opening 51 through the second communication path 55.

Meanwhile, when the ink cartridge 5 is moved toward the wall surface 85, the ink supply tube 80 is inserted through the opening 41 into the ink supply portion 32. When the ink supply tube 80 is inserted through the opening 41 into the ink supply portion 32, the ink supply valve opens the path allowing the opening 41 and the ink chamber 31 to communicate with each other. Thus, the ink in the ink chamber 31 can be supplied to the inkjet head 3 through the ink supply portion 32, the ink supply tube 80, the tube 11, the tube joint 20 and the sub-tank 4 (4*a* to 4*d*). In the state shown in FIG. 7 where the mounting of the ink cartridge 5 to the cartridge mounting portion 7 is completed, the casing 30 receives an urging force from the spring 73 in the direction opposite to the mounting direction 83 with respect to the cartridge mounting portion 7. However, the ink cartridge 5 is retained at the position in the cartridge mounting portion 7, as shown in FIG. 7, by a retaining member (not shown).

As described above, according to the ink cartridge 5 of this embodiment, in the state where the ink cartridge 5 is not mounted to the cartridge mounting portion 7, because the valve member 70 is kept being urged by the spring 73, the first valve 71 closes the first communication path 56. Accordingly, the ink stored in the ink chamber 31 does not flow into the air introduction chamber 53 and therefore does not leak to the exterior of the casing 30 through the air introduction chamber 53. In contrast, when the ink cartridge 5 is mounted to the cartridge mounting portion 7, the valve member 70 comes into contact with the pressing portion 82. The valve member 70 that has come into contact with the pressing portion 82 is moved against the urging force of the spring 73, whereby the second valve 72 closes the second communication path 55, whereas the first valve 71 opens the first communication path 56. Therefore, even if the ink stored in the ink chamber 31 flows into the air introduction chamber 53 through the first communication path 56, the ink can be prevented from leaking to the exterior of the casing 30 through the second movement-allowing chamber 52 and the second communication path 55. Moreover, the movable range of the valve member 70 can be selected from case to case by selecting the sizes of the first movement-allowing chamber 54, the second movement-allowing chamber 52, and so forth from case to case. Therefore, the valve member 70 can be assuredly moved along with the mounting of the ink cartridge 5 to the cartridge mounting portion 7.

Furthermore, the end opening 38 of the labyrinth groove 36 is positioned above the second communication path 55, the movement-allowing chamber 52, the communication path 58, and the circular opening 51 when the ink cartridge 5 is mounted to the mounting orientation. Thus, even if the ink flows into the air introduction chamber 53, the ink does not easily reach the end opening 38 of labyrinth groove 36. Accordingly, the ink can be prevented from leaking to the exterior of the casing 30.

Moreover, when the mounting direction 83 is a horizontal direction, the second communication path 55 extends from the air introduction chamber 53 forward in the mounting direction 83, whereas the third communication path 59 extends upward from the air introduction chamber 53 when the ink cartridge 5 is mounted to the cartridge mounting portion 7. Therefore, even if ink adheres around the valve member 70 when the valve member 70 is moved, the ink does not easily reach third communication path 59 because the third communication path 59 extends upward in a direction perpendicular to the direction in which the valve member 70 is moved. Thus, the ink can be prevented from leaking to the exterior of the casing 30 through the third communication path 59.

Moreover, because the gas permeable film 60 is provided in the third communication path 59, even if ink flows into the third communication path 59, the gas permeable film 60 does not allow the ink to pass therethrough. Thus, the ink can be prevented from leaking to the exterior of the casing 30 through the third communication path 59.

Moreover, the first valve 71 comprises on the outer periphery thereof the three projecting members 74*a*, 74*b*, and 74*c* provided at intervals in the peripheral direction of the first valve 71, such that the projecting members 74*a*, 74*b*, and 74*c* are in contact with the inner wall defining the first movement-allowing chamber 54. Therefore, the contact area between the inner wall defining the first movement-allowing chamber 54 and the first valve 71 can be reduced, and the sliding resistance occurring when the valve member 70 is moved can be reduced. Thus, the opening and closing of the first communication path 56 and the second communication path 55 by the first valve 71 and the second valve 72 can be realized smoothly.

As described above, when the ink cartridge 5 is mounted to the cartridge mounting portion 7, the valve member 70 comes into contact with the cartridge mounting portion 7 and is assuredly moved. This causes the ink chamber 31 and the exterior of the casing 30 to communicate with each other through the third communication path 59 and the labyrinth groove 36. Moreover, ink leakage from a position near the contact point (interface) between the valve member 70 and the cartridge mounting portion 7 to the exterior of the ink cartridge 5 can be reduced.

While embodiments of the present invention have been described by taking the above embodiment as an example, application of the present invention is not limited to such an embodiment, and various modifications can be made to the above embodiment without departing from the scope of the present invention. Modified embodiments of the embodiment will now be described.

Figure 8A:
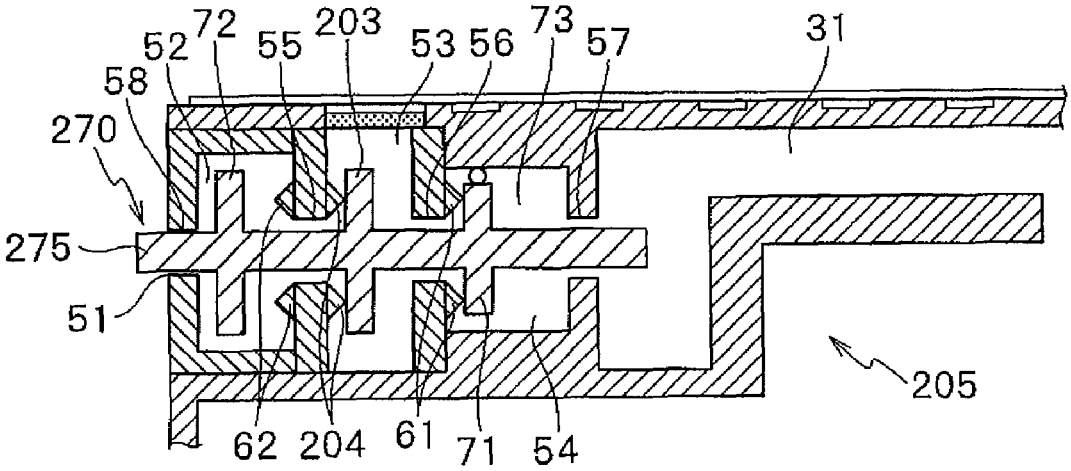
FIG. 8A is an enlarged cross-sectional view of an air introduction portion of an ink cartridge according to a modified embodiment, before the ink cartridge is mounted to the cartridge mounting portion.

While the first valve 71 and the second valve 72 are provided on the valve member 70 in the above-described embodiment, three valves may be provided on a valve member 270 of an ink cartridge 205 according to a modified embodiment, as shown in FIG. 8A. Referring to FIG. 8A, the valve member 270 comprises a shaft 275, the first valve 71 configured to open and close the first communication path 56 from the side of the first movement-allowing chamber 54, the second valve 72 configured to open and close the second communication path 55 from the side of the second movement-allowing chamber 52, and a third valve 203 configured to open and close the second communication path 55 from the side of the air introduction chamber 53. The valve member 270 movably extends through the communication path 57, the first communication path 56, the second communication path 55, and the communication path 58 that are arranged in a straight line from the ink chamber 31 to the opening 51. An annular valve seat 204 is positioned at the outer rim of an end of the second communication path 55 contiguous to the air introduction chamber 53, and the valve seat 204 is configured to come into contact with the third valve 203 of the valve member 270. The third valve 203 has a disk-like shape.

The first valve 71, the second valve 72, and the third valve 203 provided on the shaft 275 are positioned such that when the first valve 71 contacts the valve seat 61 and closes the first communication path 56, the second valve 72 is spaced apart from the valve seat 62, and the third valve 203 contacts the valve seat 204 and closes the second communication path 55.

Before the ink cartridge 205 is mounted to and is secured to the cartridge mounting portion 7, the valve member 270 is urged by the spring 73, as shown in FIG. 8A, such that the first valve 71 is in contact with the valve seat 61 and closes the first communication path 56, the third valve 203 is in contact with the valve seat 204 and closes the second communication path 55, and the second valve 72 is spaced apart from the valve seat 62.

Figure 8B:
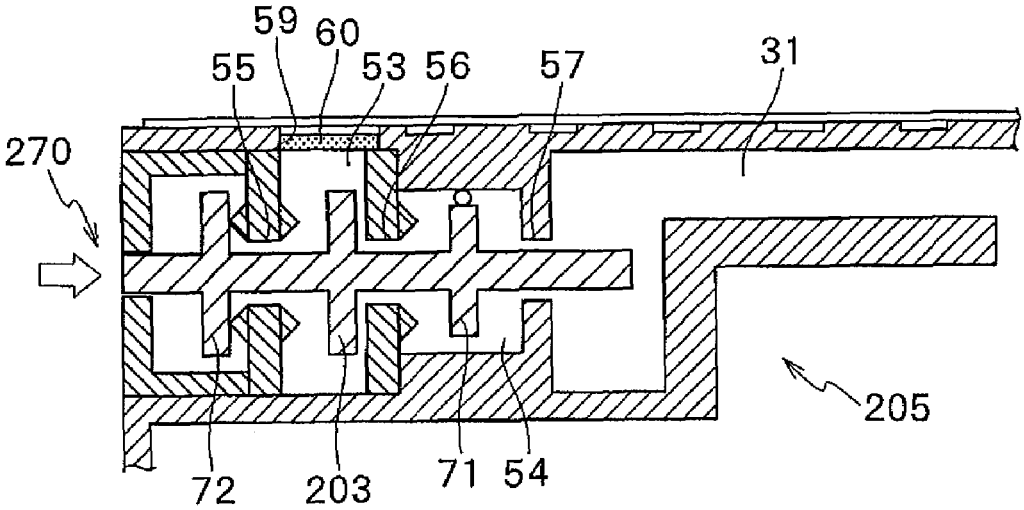
FIG. 8B is an enlarged cross-sectional view of the air introduction portion when the mounting of the ink cartridge to the cartridge mounting portion is completed.

After the mounting of the ink cartridge 205 to the cartridge mounting portion 7 is completed, the valve member 270 is positioned, as shown in FIG. 8B, such that the first valve 71 is spaced apart from the valve seat 61 and opens the first communication path 56, the third valve 203 is also spaced apart from the valve seat 204, and the second valve 72 is in contact with the valve seat 62 and closes the second communication path 55. Thus, as shown in FIG. 8B, the ink chamber 31 and the exterior of the casing 30 communicate with each other through the communication path 57, the first movement-allowing chamber 54, the first communication path 56, the air introduction chamber 53, the third communication path 59, the gas permeable film 60, the labyrinth groove 36, and the end opening 38.

When the ink cartridge 205 is removed from the cartridge mounting portion 7, the valve member 270 is positioned as shown in FIG. 8A again such that the first valve 71 is in contact with the valve seat 61 and closes the first communication path 56, the third valve 203 is in contact with the valve seat 204 and closes the second communication path 55; and the second valve 72 is separated from the valve seat 62.

Once the ink cartridge 205 is mounted to the cartridge mounting portion 7, the valve member 270 is moved against the urging force of the spring 73, whereby the first valve 71 opens the first communication path 56. In this state, ink stored in the ink chamber 31 may flow into the air introduction chamber 53 through the first movement-allowing chamber 54 and the first communication path 56. Even if the ink cartridge 205 is removed from the cartridge mounting portion 7 with the ink being in the air introduction chamber 53, the second communication path 55 is closed by the third valve 203 because the valve member 270 is urged by the spring 73. Thus, the ink that has flowed into the air introduction chamber 53 can be prevented from leaking to the exterior of the ink cartridge 205 through the second communication path 55 and the second movement-allowing chamber 52.

Figure 9:
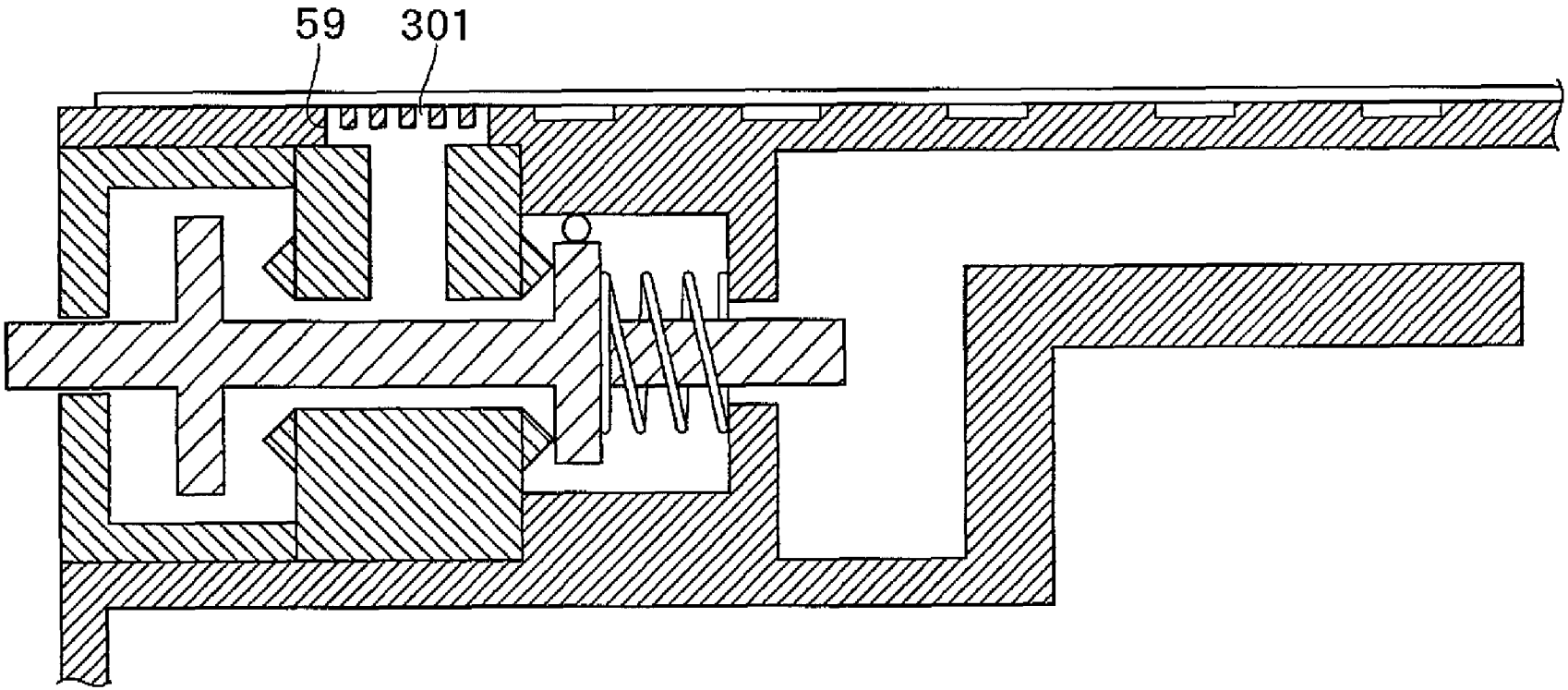
FIG. 9 is an enlarged cross-sectional view of an air introduction portion of an ink cartridge according to another modified embodiment.
Figure 10:
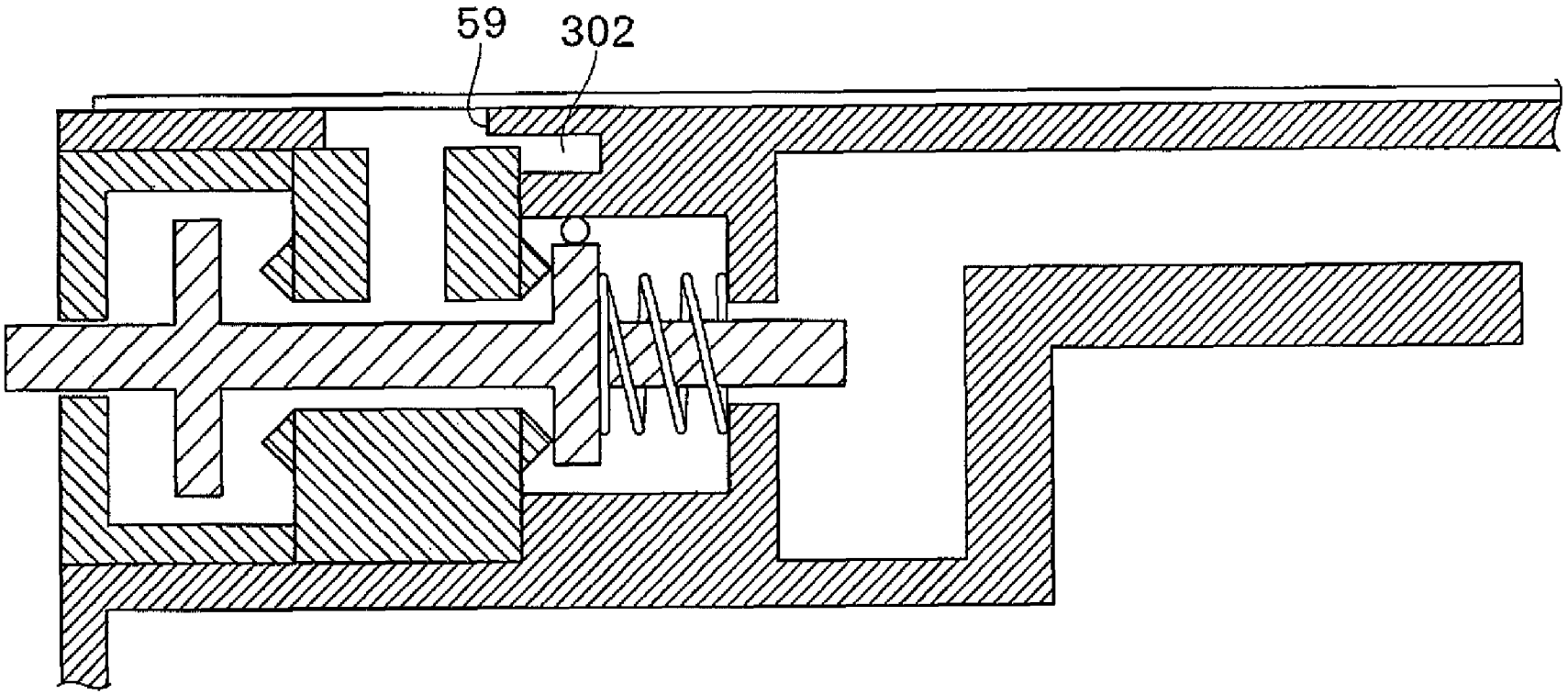
FIG. 10 is an enlarged cross-sectional view of an air introduction portion of an ink cartridge according to yet another modified embodiment.

In another modified embodiment as shown in FIG. 9, the gas permeable film 60 may be replaced with slits 301 formed in the top face of the casing 30. In yet another modified embodiment as shown in FIG. 10, an ink-receiving portion 302 for receiving and storing ink that has flowed to a portion near the third communication path 59 may be provided in the sidewall of the third communication path 59. Moreover, the third communication path 59 itself may be provided in the shape of a labyrinth.

Alternatively, the third communication path 59 may be provided without the gas permeable film 60. Even in that case, because the opening of the third communication path 59 is positioned above the second communication path 55, a function of reducing ink leakage through the third communication path 59 can be realized.

Although the mounting direction 83 is a horizontal direction in the above described embodiments, the mounting direction 83 is not limited to a horizontal direction and may be the vertical direction (the direction of gravity).

The film 37 may be transparent. In that case, when the ink cartridge 5 is viewed from the above, ink adhering to the gas permeable film 60 and ink flowing into the labyrinth groove 36, if any, can be checked easily.

The end of the shaft 75 projects to the exterior of the casing 30 through the opening 51, such that the shaft 75 and the pressing portion 82 come into contact with each other in the exterior of the casing 30 in the above-described embodiments. However, the shaft 75 may be provided so as not to project to the exterior of the casing 30. In that case, the pressing portion 82 may be inserted through the opening 51 and the communication path 58 into the second movement-allowing chamber 52, thereby coming into contact with the shaft 75 in the second movement-allowing chamber 52.

While the present invention is applied to the ink cartridge 5 to be used in the printer 1 in the above-described embodiments, the object of application of the present invention is not limited to an ink cartridge. That is, the present invention can be applied to anything regardless of the use and the type of liquid to be stored in a liquid container.

While the invention has been described in connection with various example structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. A liquid container configured to be mounted to a container mounting portion of a liquid supply device in a mounting direction, the liquid container comprising:

a container body comprising a liquid chamber formed therein, wherein the liquid chamber is configured to store liquid therein, and the container body comprises a front face facing forward in the mounting direction during a mounting of the liquid container to the container mounting portion;

a liquid supply portion configured to supply liquid from the liquid chamber to an exterior of the container body; and an air introduction portion configured to introduce air from the exterior of the container body into the liquid chamber, wherein the air introduction portion comprises:

an air introduction chamber;

a first path through which the air introduction chamber is configured to be in communication with the liquid chamber;

a second path extending in the mounting direction from the air introduction chamber and is opened to the exterior of the container body at the front face of the container body;

an air communication path through which the air introduction chamber is configured to be in communication with the exterior of the container body, wherein the air communication path is configured to introduce air into the air introduction chamber therethrough;

a valve member extending through the first path and the second path and comprising a first valve configured to open and close the first path and a second valve configured to open and close the second path, the valve member being movable, such that when the first valve closes the first path the second valve opens the second path, and when the second valve closes the second path the first valve opens the first path; and an urging member configured to urge the valve member in such a direction that the first valve closes the first path and the second valve opens the second path, wherein the valve member is configured to be moved relative to the air introduction chamber in a direction opposite to the mounting direction against an urging force of the urging member by coming into contact with the container mounting portion when the liquid container is mounted to the container mounting portion, such that the second valve closes the second path and the first valve opens the first path.

2. The liquid container of claim 1, wherein when the liquid container is mounted to the container mounting portion, the air communication path is opened to the exterior of the casing at a position above the second path.

3. The liquid container of claim 1, wherein the mounting direction is a horizontal direction, and when the liquid container is mounted to the container mounting portion, the second path extends from the air introduction chamber forward in the mounting direction, and the air communication path extends upward from the air introduction chamber.

4. The liquid container of claim 1, further comprises a gas permeable film positioned in the air communication path.

5. The liquid container of claim 1, wherein the valve member comprises a plurality of projecting members projecting from an outer periphery of at least one of the first valve and the second valve, such that the plurality of projecting members contacts an inner wall of the liquid container defining at least one of the first path and the second path, wherein the plurality of projecting member is positioned at intervals in a peripheral direction of at least one of the first valve and the second valve.

6. The liquid container of claim 1, wherein the valve member further comprises a third valve configured to open and close the second path, wherein the third valve closes the second path when the valve member is urged by the urging member, and the third valve opens the second path when the valve member is moved relative to the air introduction chamber in the direction opposite to the mounting direction against the urging force of the urging member.

7. A liquid container comprising:

a container body comprising a liquid chamber formed therein, wherein the liquid chamber is configured to store liquid therein;

a liquid supply portion configured to supply liquid from the liquid chamber to an exterior of the container body; and an air introduction portion configured to introduce air from the exterior of the container body into the liquid chamber, wherein the air introduction portion comprises:

an air introduction chamber;

a first path through which the air introduction chamber is configured to be in communication with the liquid chamber;

a second path extending from the air introduction chamber and is opened to the exterior of the container body;

an air communication path through which the air introduction chamber is configured to be in communication with the exterior of the container body, wherein the air communication path is configured to introduce air into the air introduction chamber;

a valve member extending through the first path and the second path and comprising a first valve configured to open and close the first path and a second valve configured to open and close the second path, the valve member being movable, such that when the first valve closes the first path the second valve opens the second path, and when the second valve closes the second path the first valve opens the first path; and an urging member configured to urge the valve member in such a direction that the first valve closes the first path and the second valve opens the second path, wherein the valve member is configured such that, when the valve member is moved by an external force acting against an urging force of the urging member, the second valve closes the second path and the first valve opens the first path.

8. The liquid container of claim 7, further comprises a gas permeable film positioned in the air communication path.

9. The liquid container of claim 7, wherein the valve member comprises a plurality of projecting members projecting from an outer periphery of at least one of the first valve and the second valve, such that the plurality of projecting members contacts an inner wall of the liquid container defining at least one of the first path and the second path, wherein the plurality of projecting member is positioned at intervals in a peripheral direction of at least one of the first valve and the second valve.

10. The liquid container of claim 7, wherein the valve member further comprises a third valve configured to open and close the second path, wherein the third valve closes the second path when the valve member is urged by the urging member, and the third valve opens the second path when the valve member is moved by the external force acting against the urging force of the urging member.

* * * * *